United States Patent [19]

Ferrari

[11] Patent Number: 4,765,599

[45] Date of Patent: Aug. 23, 1988

[54] APPARATUS FOR THE AUTOMATIC FORMING OF CONTINUOUS METAL TUBE FILLED WITH POWDERED MATERIALS, ITS DIRECT INTRODUCTION INTO LIQUID METAL, AND RELATED EQUIPMENT

[75] Inventor: Lorenzo Ferrari, Lugano, Switzerland

[73] Assignee: Kinglor-Ltd., Lugano, Switzerland

[21] Appl. No.: 103,277

[22] Filed: Oct. 1, 1987

Related U.S. Application Data

[62] Division of Ser. No. 940,115, Dec. 10, 1986, Pat. No. 4,711,663.

[51] Int. Cl.[4] ..... C21C 7/00

[52] U.S. Cl. ..... 266/216; 75/53; 75/58

[58] Field of Search ..... 266/216; 75/53, 58

[56] References Cited

U.S. PATENT DOCUMENTS

| | | | |
|---|---|---|---|
| 4,126,446 | 11/1978 | Knorre | 75/93 G |
| 4,363,470 | 12/1982 | Ives | 75/53 |
| 4,364,770 | 12/1982 | Douchy | 75/53 |
| 4,486,227 | 12/1984 | Douchy | 75/53 |

FOREIGN PATENT DOCUMENTS 2139924 6/1984 United Kingdom .

*Primary Examiner*—Peter D. Rosenberg

*Attorney, Agent, or Firm*—Collard, Roe & Galgano

[57] ABSTRACT

An apparatus suitable for forming a metal tube filled with powders for the treatment of a liquid metal bath is disclosed. The apparatus includes a feeding unit provided with rollers capable of unrolling a metal sheet from a roll and advancing it into a filling chamber where powders supplied from separate hoppers are charged on the sheet by a powder metering unit. The metering unit includes a device for continuous weighing of the powders to be supplied. A programmer or computer is used for calculating the required powder amounts. A roller shaping device is provided which forms the sheet into the shape of an open U-shaped channel. A roller forming means is also provided for closing the U-shaped channel to form a continuous tube by partially overlapping the side flanges of the U-shaped tube. Finally, a guiding and introduction device moves the just-formed tube under the surface of the molten liquid bath in the ladle.

6 Claims, 1 Drawing Sheet

Figure 1:
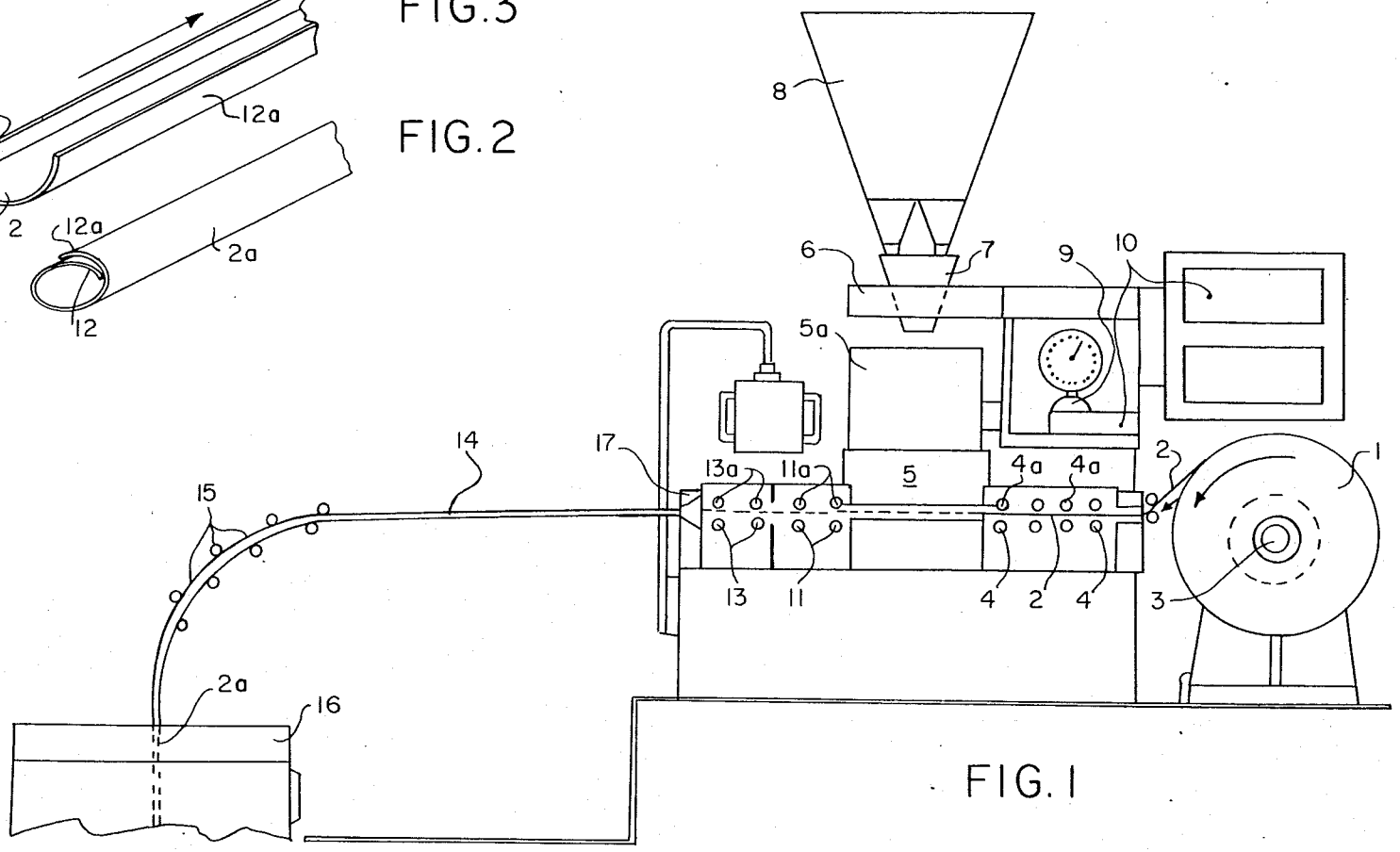

APPARATUS FOR THE AUTOMATIC FORMING OF CONTINUOUS METAL TUBE FILLED WITH POWDERED MATERIALS, ITS DIRECT INTRODUCTION INTO LIQUID METAL, AND RELATED EQUIPMENT

This is a division of application Ser. No. 940,115, filed Dec. 10, 1986, now U.S. Pat. No. 4,711,663.

The object of the present invention is to provide an apparatus for the automatic forming of a continuous metal tube filled with powdered materials such as ferroalloys and/or other materials or material blends, usually denominated as "cored wire", and used in metal production technology, in particular for the production of steel by in-ladle metallurgy, and for the direct introduction of the same wire into the bath of liquid metal poured into the ladle to the purpose of carrying out the suitable treatments before the casting.

It is also within the scope of the present invention an automatic equipment having such a structure as to allow the forming of a cored wire and its direct dipping into the bath of liquid metal.

It is known that the technology for the production of metals, in particular of steel, by in-ladle metallurgy, requires the addition to the liquid bath of various corrective elements, in powder form, such as deoxidizers, ferroalloys, desulphurizer elements, alloying elements, scorifiers, and still others such as salts and/or oxides of various metals, addition which is carried out in the step of metal tapping from smelting furnace.

For the introduction of these inoculants, various different techniques have been accomplished and adopted, among which one envisages the injection into the liquid mass of powdered metal elements pneumatically conveyed by inert gas (e.g., argon or nitrogen), and introduced under the surface of liquid metal by means of a suitable nozzle provided with inner bore; this technique results satisfactory for injections of large amounts of powders, but shows the drawbacks of requiring complex and expensive equipment, of having poor precision as for the amounts of powder to be introduced, and of offering a rather uneven powder efficiency, due to the presence of conveying gas, which often drags to surface a portion of powdered product, both because the conveyance takes place in a pulsating fashion, and because the pressure of liquid mass tends to counteract the injection nozzle dipping action.

Another injection technique which has been recently favourably considered due to its operative simpleness and to the reliability and repetitiveness of its results is that envisaging the use of so-called "cored wire", i.e., a continuous tube of metal sheet, previously filled with treatment powders (ferroalloys, Al, sulphur and others) which is introduced under liquid's surface in the ladle.

In practice however this technique, even if showing the advantage of requiring low-cost equipment, and of resulting of particularly simple use, shows drawbacks and limitations which, briefly, can be summarized as follows:

the amount of powder contained inside the cored wire cannot be controlled by the user, who must hence rely upon the supplier's correctness;

in order to change the type of cored wire, i.e., containing the required types of powdered materials, having available a plurality of previously prepared bobbins of cored wire, and related machinery with a plurality of swifts for supporting the same bobbins is necessary;

the bobbin change operations, the extraction of cored wire length remaining inside the introduction duct, and the subsequent reintroduction of the new cores wire, require time and many interventions;

storage costs, delays in supply, and, finally, difficulties in the preparation of the wire with blends preestablished and studied for particular uses, and impossibility to keep confidential the composition of the same blends for a long time.

Purpose of the present invention is hence to provide a process for the forming of cored wire capable of overcoming all the drawbacks and the limitations of systems for the production and use of cored wire used up to now in the metallurgical treatment in ladle, process utilizable in the metallurgy both of steel and of other metals and metal alloys, such as, e.g., aluminum and its alloys.

Other purpose of the invention is to provide an equipment installable in the nearby of the ladle, having such a structure as to continuously produce cored wire containing blends of treatment powders having the desired compositions, with guarantee of composition constancy, and evenness in tube filling, and, above all, such as to allow the in-ladle treatment steps, including the introduction of the cored wire under the liquid bath surface, to be carried out in a completely automatic and computerized way.

A further purpose of the invention is to provide an equipment of the above-specified type with particularly simple and reliable structure, with high flexibility as for the possibility of programming and varying the compositions of the treatment powders, and of low cost, both of installation and of operation.

These purposes and related advantages, together with still others, which can be evidenced by the following disclosure, are achieved by a process for the forming, in an automatic and continuous way, of a metal tube filled with powdered elements, such as ferroalloys and other elements, utilizable in the metallurgical treatment in ladle at the same time of its forming, which process consists, according to the present invention, in making a tape of flat sheet unroll from a roll, in making advance it horizontally through a filling matrix, then in depositing onto the sheet a metered and weighted amount of treatment powders fed from separate hoppers, in making further advance the sheet so loaded with metered amounts, and then in bending the side zones or edges of the sheet, so as to make it assume a shape substantially as of a capital "U" or of open channel, in then conferring it the shape of a closed tube with the compacted powder inside it, by partial overlapping of the flanges of said "U"-shaped continuous channel to each other, and finally in progressively delivering the so obtained tube immediately under the surface of liquid metal in a ladle, keeping it constantly guided.

More particularly, said treatment powders are constituted by ferroalloys, by deoxidizer elements, by scorifying elements, by alloying elements, and by all those elements normally used in the in-ladle treatment of liquid steel, in the treatment of aluminum and its alloys both in smelting furnace and in holding furnace, and of other metals, both for their treatment and for the formation in situ of particular alloys thereof.

Always according to the present invention, an equipment particularly suitable to practically produce such cored wire, and to continuously introduce it under the surface of liquid metal bath of a ladle or the like, contemporaneously to its forming, is constituted:

by a support base;

by a flat tape of metal sheet, such as steel, aluminum, or other metal materials, unrolling from an accumulation roll;

by a feeding unit provided with rollers opposite to each other, or similar means, suitable to make said sheet horizontally advance, pushing it inside a filling matrix, substantially a containment chamber, positioned beneath a metering-feeder unit for the powders fed from separate hoppers, to said metering-feeder unit a device for the continuous and automatic weighing of the amounts of powders to be used, and a unit, substantially a process computer, for the programming of the same amounts with predetermined time sequence, repetitive and of constant duration, relatively to the type and amount of molten metal to be treated, and to the analyses previously carried out to the same metal being associated;

by roller shaping means or the like, suitable to bend said sheet, up to make it assume a cross section with shape substantially as of a capital "U", containing the metered powder amounts;

by roller forming means, or the like, for the closure of "U"-shaped sheet to the form of a continuous tube, and contemporaneous compacting of the powder enclosed inside it, said tube closure being achieved by means of the partial overlapping of the side flanges of the said sheet, and finally by means for guiding and means for introducing the just formed tube under the surface of ladle molten metal, said guide and introduction means being subjected to a mechanical, pneumatic, or the like, device, suitable to confer a combined motion to the axis of tube introduction into the liquid metal, for greater operation safety.

Figure 2:
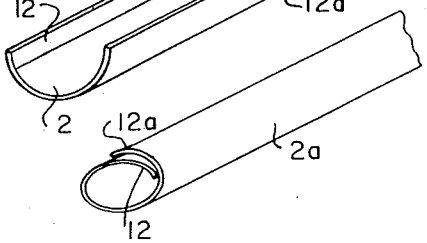
Figure 3:
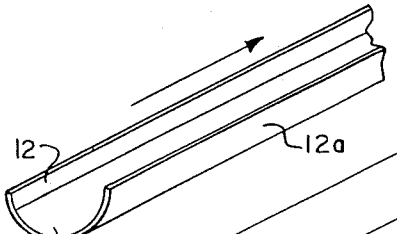

The invention, as for a preferred and not exclusive form of practical embodiment thereof, is hereunder disclosed in detail with reference to the attached drawing table, given to indicative and not limitative purpose, wherein:

FIG. 1 shows, in schematic form, the main structural elements composing the cored wire forming equipment, accomplished according to the invention, and FIGS. 2 and 3 are perspective shows of a length of cored wire, respectively under the conditions of "U"-shaping, and of end forming to the shape of closed and filled tube, produced according to the process and relevant equipment, both being object of the present invention.

Referring to such figures, the cored wire forming equipment according to the invention can be accomplished either in a position close to one or to a plurality of casting ladles or, if necessary, on a wheeled flatbed, so as to be suitable to be transferred to the required use areas.

The equipment is substantially constituted by at least one roll 1 of metal sheet tape 2, preferably of steel, but also of aluminum, its alloys, and other metals, which is mounted idle on its own axle 3; the sheet tape 2, unrolled from the roll, is made pass between pairs of advancement rollers 4—4*a*, rotatable at a preestablished and adjustable speed, which are driven by motor means not shown.

The sheet, pushed by rollers 4—4*a*, is introduced into a filling matrix 5, which is substantially formed by a prismatic chamber, open atop, on whose bottom the sheet translates, whilst the opposite vertical or spread-apart walls 5*a* constitute the guide and retaining means for the powders fed from upward into the same chamber, as it is hereunder specified.

Above the filling matrix 5 a metering device 6 is positioned, provided with loading hopper 7, which receives the powder elements (ferroalloys, deoxidizers, scorifiers, alloying elements, salts and other products used in in-ladle metallurgy) from an upper hopper 8, internally subdivided into various compartments to the purpose of making it possible to discharge onto the metering device 6 the amounts of different powders necessary to constitute the programmed blends to discharge onto the sheet inside the matrix 5.

The metering device 6 is associated to an automatic weighing scale 9, which is subjected in its turn to an electronic programmer, substantially a process computer, generally and schematically indicated with 10 in FIG. 1 and however of known type. Such an arrangement allows, on the basis of the amounts of liquid metal to be treated in ladle end of the analyses of same liquid metal, to predispose, sequentially, the selection of the powders, and the amounts necessary to accomplish the blends to be sent to the weighing according to a strictly repetitive pattern, such as to secure the desired end result.

The powder and/or the blend of metered and weighed powders is then deposited on the face of the sheet travelling at the base of matrix 5. The so-charged sheet is then pushed through pairs of shaping rollers 11—11*a*, which, through their suitably shaped outer surfaces cause the longitudinal zones or flanges 12—12*a* (FIG. 3) to be folded upwards, so conferring to the sheet 2 a shape substantially as of a capital "U". Always according to the invention, the "U"-shaping can be conferred to the sheet before that it reaches the filling matrix, by suitably shaping the outer surface of feeding rollers 4—4*a*. The sheet so shaped and containing the metered amounts of powder is made advance between further pairs of forming rollers 13—13*a* which, by means of a suitable shaping of their outer surfaces, close the "U"-cross section of the sheet up to make it assume a substantially round and closed section, and that due to partial overlapping of flanges 12—12*a* to each other, as shown in FIG. 2. The folding with overlapping of the flanges involves advantageously an efficacious compacting of the powders enclosed within the tube, which offers the necessary guarantee of filling constancy and use reliability.

The compacting can be further improved by predisposing suitable rollers or similar devices for the compression of powder in sheet's "U"-zone.

At the outlet of forming rollers 13—13*a*, the tube 2*a* which is being progressively formed is sent into a guide and retention duct 14 which has an a curved shape and is retained, e.g., by guide rollers 15, so as to send the tube 2*a* coming out from the free end of the same duct 14 into a ladle 16 containing the liquid metals to be treated.

Moreover, according to the invention, to the tube guide duct 14 a mechanical, pneumatic or hydraulic device, generally indicated with 17 in FIG. 1, is applied, capable of conferring to the same duct 14 a slight combined motion of partial rotations, into the two directions, aroung its axis and of partial reciprocating axial shifts, to the purpose of achieving a higher operating safety, with particular reference to the wear of ladle refractory lining, and a greater homogeneity of liquid metal treatment.

From what has been exposed above, and from what results from the attached drawings, further considerable advantages, in addition to those as above mentioned, result clear, above all as for the operating practice and the consequent financial and qualitative results.

Such advantages can be summarized as follows:

absence of fortuitous losses of powders contained inside the tube, both during its manufacturing and during its introduction into the ladle, losses which on the contrary may easily occur with the longitudinally grafted cored wires as a consequence of their handling during the transportation of the rolls and their installation in operation position, all operations which may cause changes in powder metered amount inside the tube, and hence unevenness of treatment in ladle, possibility of using metal tapes of thickness and width suitable to the use requirements, and above all to obtain the right degree of powder dissolving into the liquid bath; in general, the thickness of the sheet is kept as low as possible in order not to act too negatively on the ratio between powders' weight an cored wire's unitary weight, possibility of applying higher axial thrust forces to the cored wire, in that the advancing action can be totally imposed to the pre-"U"-shaped tape before its filling, and not to the already filled cored wire which, due to its structure, is particularly compressible, elimination of the burdensome operation of tube axial grafting, in that a partial overlapping of the flanges of "U"-shaped channel is more than enough to allow the tube to be transferred into the ladle, without powder losses.

Obviously, in the practical embodiment, into the invention as hereinabove disclosed according to a preferred and not exclusive form thereof, structurally and functionally equivalent changes and variants may be introduced, always within the protection scope of the same invention.

What is claimed is:

1. An apparatus for forming a continuous metal tube filled with powder additives capable of use in an in-ladle metallurgical treatment process for molten metal comprising:

a support base;

a roll of flat metal sheet in close proximity to said base;

a supply means mounted on said base with opposed rollers for unrolling said sheet metal and for making said sheet advance horizontally into a position adjacent to a means for metering, weighing and feeding the powder additives onto said metallic sheet;

said means for metering, weighing and feeding the additives capable of metering and weighing the additives prior to the feeding thereof onto said metallic sheet;

comuter means capable of controlling said means for metering and weighing so that a predetermined amount of additives are fed onto said sheet, said predetermined amount being calculated by said computer based on the type, quantity, and determined characteristics of said molten metal;

a roller means capable of folding side flanges of said sheet to form a generally U-shaped channel;

a means for overlapping said side flanges such that said additives are compacted and said sheet forms, in situ, a continuous tubular member; and a means for immediately introducing said just-formed tubular member under the surface of said molten metal in the ladle.

2. An apparatus set forth in claim 1, wherein said metallic sheet is formed into said U-shape by roller means associated with portion of said opposed rollers of said supply means prior to receiving said additives.

3. An apparatus as set forth in claim 1, wherein said supply means comprises a set of driven rollers positioned away from the molten metal and in close proximity to said roll of flat sheet metal so that the force required to advance said sheet is applied to a flat indeformable sheet.

4. An apparatus as set forth in claim 1, further including means for imparting movement of said tube at the point of introduction thereof into said molten metal.

5. An apparatus as set forth in claim 1, wherein said means for introducing said tube into said molten metal imparts movement thereto which movement includes partial rotational and reciprocating axial movements of said tube to obtain a greater homogeneity for the treatment of said molten metal.

6. An apparatus as set forth in claim 1, wherein said metering and weighing devices are so structured as to allow said feeding onto said the sheet of predetermined amounts of each of said additives by controlling the metering time and the weighed amounts thereof with said computer means.

* * * * *